US005842607A

United States Patent [19]

Snider

[11] Patent Number: 5,842,607

[45] Date of Patent: Dec. 1, 1998

[54] LATHER DEVICE

[75] Inventor: John H. Snider, Clinton, Mo.

[73] Assignee: Adam & Eve Enterprises, Inc., Yonkers, N.Y.

[21] Appl. No.: 625,646

[22] Filed: Mar. 29, 1996

[51] Int. Cl.[6] ..... B67D 5/60

[52] U.S. Cl. ..... 222/145.6; 222/189.11; 222/190; 222/195; 222/401

[58] Field of Search ..... 222/145.5, 145.6, 222/189.11, 190, 195, 399, 401

[56] References Cited

U.S. PATENT DOCUMENTS

| | | | |
|---|---|---|---|
| 2,653,848 | 9/1953 | Lee | 222/190 |
| 3,712,512 | 1/1973 | Snider, Jr. et al. | 222/190 X |
| 4,349,131 | 9/1982 | Arabian | 222/135 |
| 4,477,000 | 10/1984 | Arabian | 222/135 |
| 4,531,660 | 7/1985 | Ford, Jr. | 222/209 |
| 4,615,467 | 10/1986 | Grogan et al. | 222/189 |
| 4,880,161 | 11/1989 | Wright | 239/330 |
| 4,901,925 | 2/1990 | Blake, III | 222/190 X |
| 5,033,654 | 7/1991 | Bennett . | |
| 5,222,633 | 6/1993 | Blake | 222/179 |
| 5,255,851 | 10/1993 | Tobler | 239/343 |
| 5,398,845 | 3/1995 | Meyer | 222/1 |

*Primary Examiner*—Joseph Kaufman

*Attorney, Agent, or Firm*—Graham & James LLP

[57] ABSTRACT

A simplified device for use with dilute soapy water in a container, with the device being adapted to mechanically convert the soapy water together with ambient air into a dense lather. The device comprises a manually operable bladder as a pressurized ambient air source and the only moving part. The device further comprises conduits for movement of air and soapy water, a mixing chamber, specifically sized orifice entries into the mixing chamber for predetermined metered entry of the air and soapy water into the mixing chamber, an elongated porous plug for the mixing chamber and various check valves. In operation, a portion of the pressurized air is directed through a first conduit, to provide air, through a specifically sized orifice, into the mixing chamber. Simultaneously therewith, another portion of the pressurized air is directed through a second conduit into a soapy water reservoir to force a predetermined relative amount of soapy water through a third conduit and a second specifically sized orifice, into forcible engagement with incoming air in the mixing chamber. The resultant foam is forcibly pushed through the porous plug to form lather. A single application of air pressure consistently provides the requisite ratio mixture to the mixing chamber, while drawing additional soapy water into the reservoir. The foam is expressed through a porous nylon sponge element to form the foam.

10 Claims, 2 Drawing Sheets

LATHER DEVICE

FIELD OF THE INVENTION

This invention relates to devices for converting soapy water to a lather suitable for shaving, bathing, hair styling, barbering and the like, and particularly to devices utilizing ambient air in forming the lather.

BACKGROUND OF THE INVENTION

In the past, a common source for soap lather was the self contained pressurized aerosol container in which a compressed propellant created and forced a continuous stream of lather through a dispensing nozzle. Because of environmental concerns regarding the propellants most commonly used (generally fluorocarbons), production and utilization of aerosol source lather has been severely restricted.

Compressed ambient air, while obviously ideal from an environmental standpoint, is unsuitable, as being insufficiently storable in pressurized containers for similarly forming lather from an aerosol container. Accordingly, many devices have been developed which instead utilize a continuing source of compressed air from an ambient air supply. These devices however, have all had one feature in common, which has stunted the widespread commercial utilization thereof. The devices are all of complicated structure, requiring numerous components, including springs, levers, movable valve mechanisms, etc., many of which are either costly, or are not amenable to economical assembly. In addition, because of their number and interrelation, such devices are also readily subject to malfunction.

SUMMARY OF THE INVENTION

It is therefore an object of the present invention to provide a simple, economical, yet effective device for forming lather from soapy water and ambient air, essentially without moving parts, aside from means for compressing the air, and limited movement directional check valves.

It is a further object of the present invention to provide a device, which, with single introduction of compressed air, simultaneously transports and effects mixing of soapy water and compressed air in a controlled, predetermined ratio, and forms and dispenses a lather, while also replenishing the available supply of soapy water for continued operation.

It is yet another object of the present invention to provide the device which economically forms the lather from highly diluted soapy water.

These and other objects, features and advantages of the present invention will become more evident from the following discussion and drawings in which:

DETAILED DESCRIPTION OF THE INVENTION

Generally the present invention comprises a device for converting soapy water into lather by admixture with pressurized ambient air. The device comprises a soapy water reservoir and ambient air pressurizing means, which can either be manually operated such as in the form of a compressible bladder (preferably with a biased automatic return characteristic) or of an automatic continuous nature, such as an air compressor. The device further comprises separate conduit means for: the passage of pressurized air directly from the pressurizing means to a mixing chamber; for the passage of pressurized air, as a propellant, from the pressurizing means to the reservoir containing a dilute solution of soapy water; and for the propellant air-forced passage of soapy water from the reservoir to the mixing chamber.

Activation of the air pressurizing means initiates means for the simultaneous introduction of pressurized air and soapy water through separate inlets to the mixing chamber. Preferably, the inlets are positioned to provide simultaneous and continuous direct collision between the introduced pressurized air and soapy water. The mixing chamber is of minimal dimensions for maintaining pressure and is provided with measured metering means for maintaining an influx of soapy water and pressurized air with a predetermined, substantially constant ratio therebetween. Preferably, for economic considerations, the measured metering means comprises restriction means, between the conduit means and the mixing chamber such as reduced size orifices (of specific diameter) leading from the conduit means to the mixing chamber, at the soapy water inlet and at the air inlet to the mixing chamber. A controlled predetermined ratio, is determined for the soapy water and air which is ideally suitable for the formation of a foam of relative large bubbles with a controlled balance of back pressure and push through pressure.

The device further comprises porous means through which the large bubbles of the foam are expressed and reduced in size to form the very small bubble lather, for external dispensing through dispensing means. The porous means, may comprise a microperforated metal screen or more preferably an economic plug such as of a porous open celled nylon sponge material.

The soapy water from which the lather is formed must be of a dilute nature in order to avoid clogging of the small orifices of the device of the present invention and to facilitate pressurized air induced flow thereof through the conduits. Commercially available liquid body soaps such as are commercially available from the Proctor and Gamble Co. under the Ivory trademark, is a preferred soap source when substantially diluted, e.g. by about two thirds (i.e. two parts water to one part soap solution by volume). The dilution has the beneficial economic effect of providing substantial amounts of lather from a limited source supply.

DETAILED DESCRIPTION OF THE DRAWINGS AND THE PREFERRED EMBODIMENTS

Figure 1:
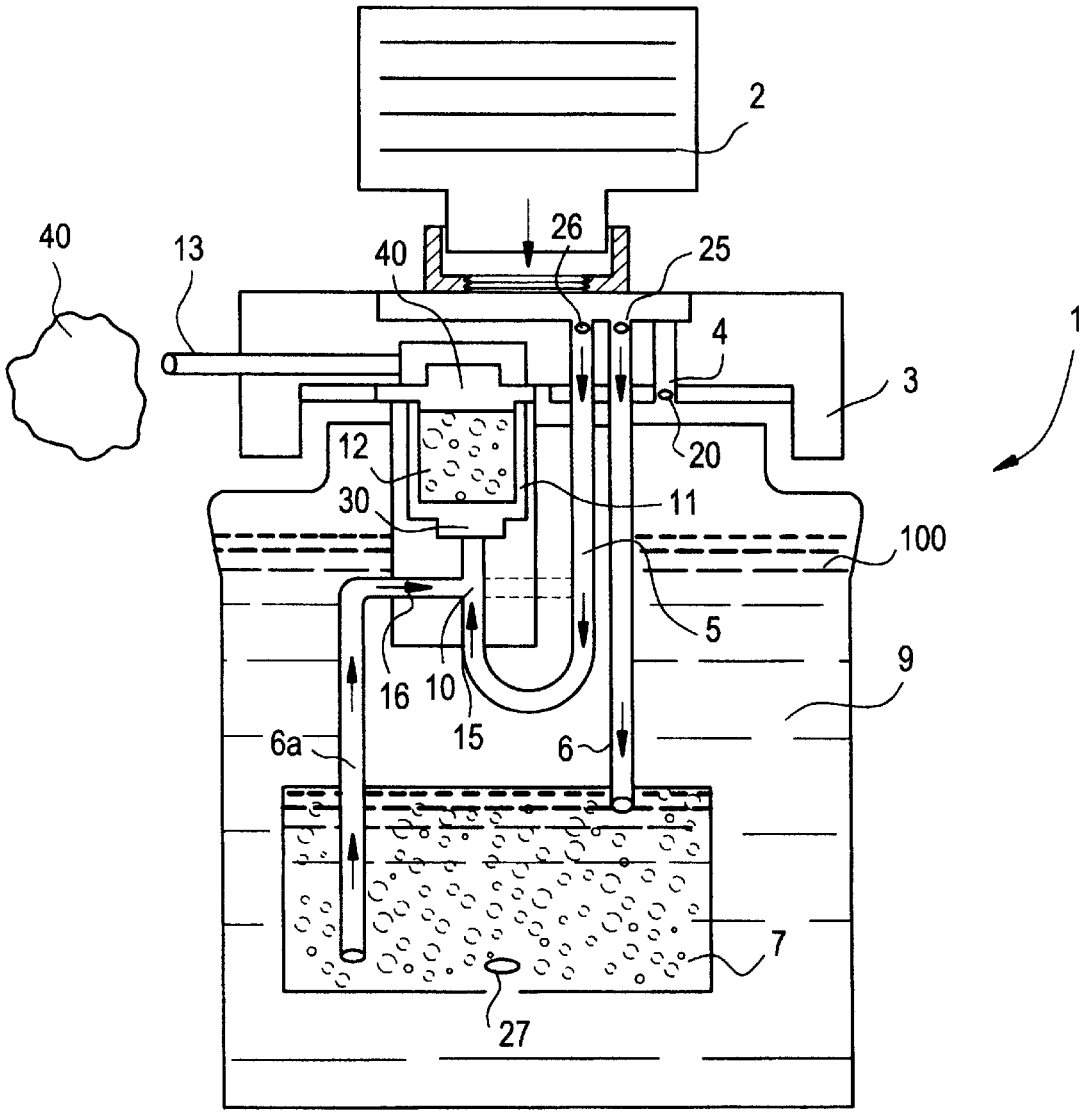
FIG. 1 is a cross sectional view of the operative components and structure of the present invention with a manually operated air compressor.

With reference to the drawings, as seen in FIG. 1, the manually operable lather forming device 1 is adapted to be seated upon an open mouthed jar 100 having dilute soapy water 9 therein, with collar lid 3 being fitted onto the upper lip of jar 100. Portions of the device extend below seat collar 3 and into the jar. The device 1 has a small reservoir 7, which is submerged into the soapy water of the jar, whereby soapy water is supplied from the jar, and wherein the reservoir supplies the soapy water for forming the lather.

Plastic bellows 2 is externally compressible to provide about five pounds of pressure to ambient air drawn into the device, through inlet 4 from the air above the soapy water in the jar. Compression of bellows 2 with air pressurization and movement works to simultaneously effect lather formation and dispensing and refilling of the reservoir as will be described.

Compressed air conduits 5 and 6 extend from collar 3 into the reservoir 7 and mixing chamber 10 respectively. Soapy water conduit 6*a* extends from close to the base of the reservoir to mixing chamber 10. Reservoir 7 has a small inlet check valve 27 at the base thereof for continual introduction of soapy water, as required and in pre-determined measured amounts. Collar 3 of the device is adapted to loosely fit on the open mouthed jar 100 with ambient air having access to the jar above the soapy water and the reservoir 7 is sized for insertion through the open mouth of the jar.

Check valves 25 and 26 between bellows 2 and conduits 5 and 6 are spring biased towards bellows 2 whereby compression of the bellows causes them to open and relief of pressure causes them to close. Check valve 20 between bellows 2 and jar 100 is spring biased away from the bellows and is closed with compression of the bellows.

In operation, air which is initially contained in the bellows 2 is pressurized by the compression of the bellows to force the air through conduit 5 directly into mixing chamber 10 through aperture inlet 15 of predetermined specific diameter. At the same time additional pressurized air is forced into the reservoir 7 via conduit 6. Reservoir 7 is sufficiently small such that the induced air pressure is transmitted through the soapy water 9 to force a small amount thereof through conduit 6*a* and into mixing chamber 10 via aperture inlet 16 of predetermined specific diameter. The size of aperture inlets 15 and 16 are correlated but may be changed provided the correlation is maintained to permit ingress of a specific ratio of soapy water and compressed air. Operative dimensions include 0.030" inch diameter for aperture 15 correlated to a 0.056" diameter for aperture 16. It is highly preferred that apertures 15 and 16 directly oppose one another in the mixing chamber 10 in order to facilitate and enhance the pressurized mixing. Continued application of air pressure expresses the foam 30, formed by the air and soapy water mixture, through porous sponge plug element 12 having the relative dimensions of 9/16" by 0.5" height. The sponge element is suitably a cylindrical section of a standard porous nylon sponge retained in lather forming chamber 11. A thick rich lather 40 is emitted from the sponge element into and out of dispensing nozzle 13. The controlled ratio of air to soapy water permits effective utilization of the inexpensive sponge element, without back pressure or excessive force through, either of which will defeat the proper formation of the lather. Back pressure is prevented by reseating of the spring loaded check valve 25 upon release of the bellows and excessive force through is prevented by the reduction in diameter of the inlet apertures, into the mixing chamber, of the air and soapy water, as well as the degree of porosity of the sponge element. Porosity of the sponge element is from about 40–60% to provide a balance between complete back pressure (a solid plug) and non-lather forming release of the foam (absence of a plug).

With release of the bellows 2, a partial vacuum is formed within the bellows. This causes ambient air from above the soapy water 9 in jar 100, to open check valve 20 to permit air to flow to the bellows through air inlet 4. Equalization of pressure causes the spring loaded valve 20 to reseat and to close the inlet. At the same time, reseating of check valve 26 causes a slight vacuum above the reservoir, sufficient to open check valve 27 whereby additional soapy water of predetermined amount enters the reservoir.

Figure 2:
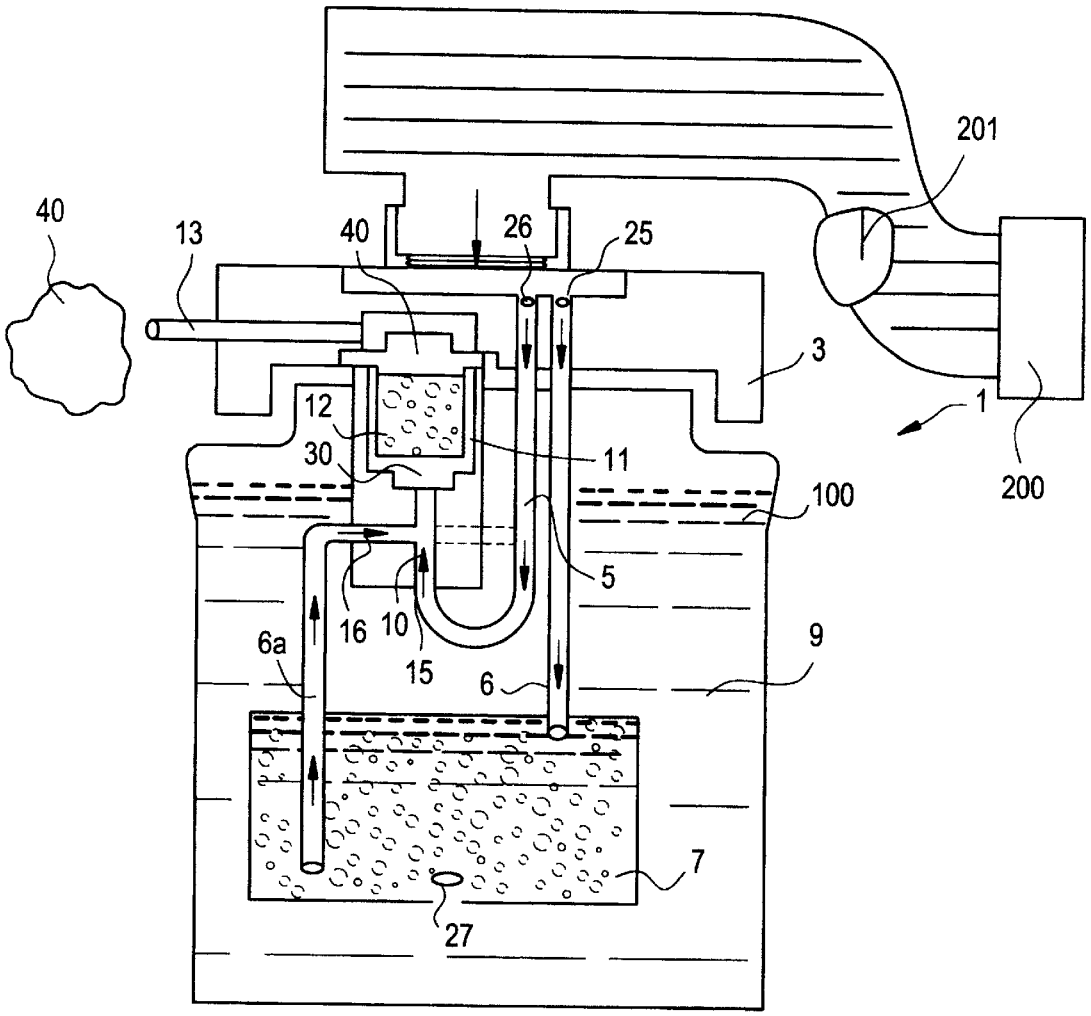
FIG. 2 is a cross sectional view of the operative components and structure of another embodiment of the present invention with a continuous running automatic compressor.

As shown in FIG. 2, the components are essentially the same as those for the manually operated device with the exception of the elimination of air inlet 4 and its related check valve 20 and the inclusion of an electric or other power trigger 201 for activation of a connected air compressor 200. In variations of this embodiment, an in wall lather dispenser can be provided in a shower or bath with continuous compressed air push-button activation.

It is understood that the above description and drawings are exemplary of the present invention and that changes may be made to the components and structure of the present invention without departing from the scope of the present invention as defined in the following claims.

What is claimed is:

1. A device for use with dilute soapy water contained in a container, whereby said device mechanically converts a mixture of the soapy water and pressurized ambient air into a dense lather, wherein said device comprises a source for pressurized ambient air, a reservoir as a direct source for the soapy water to be converted to lather, a mixing chamber for admixture of the soapy water and the pressurized ambient air and the formation of a foam therein, a lather formation chamber containing a porous member for converting foam to lather by forced passage of the foam therethrough; said device further comprising first conduit means providing a direct air connection between the source for pressurized ambient air and the mixing chamber; second conduit means providing a direct air connection between the source for pressurized ambient air and the reservoir; third conduit means providing a connection for flow of soapy water from the reservoir to the mixing chamber; measured metering means between the mixing chamber and each of the first and third conduit means respectively whereby a fixed ratio of compressed air to soapy water is maintained in said mixing chamber; and porous means capable of converting foam to lather by the forced expressing of foam therethrough.

2. The device of claim 1 wherein deactivation of the source for pressurizing the ambient air activates means for refilling the reservoir with additional soapy water from the container.

3. The device of claim 2 wherein said source for pressurizing the ambient air comprises a manually operable compressible member capable of returning to an uncompressed position upon release thereof.

4. The device of claim 3 wherein said compressible member comprises a bellows.

5. The device of claim 4 wherein said device comprises air inlet means which is opened upon release of the bellows, to provide air within said bellows to aid in the return thereof to the uncompressed position.

6. The device of claim 2 wherein said first and second conduit means contain respective valve means which close off passage access between the source for pressurizing air and the mixing chamber and reservoir respectively when the source is deactivated.

7. The device of claim 6 wherein said mixing chamber comprises inlets for the soapy water and pressurized air, which inlets are directly opposite each other in the mixing chamber.

8. The device of claim 6 wherein said mixing chamber comprises inlets for the soapy water and pressurized air, which inlets are of a diameter reduced from that of the respective conduit means, whereby the reduced diameter inlets comprise the measured metering means.

9. The device of claim 8 wherein the inlet for the pressurized air is about 0.03" in diameter and the inlet for the soapy water is about 0.056" in diameter.

10. The device of claim 8 wherein the porous member comprises a cylindrical plug of an open celled sponge material.

* * * * *